US008579602B1

(12) United States Patent
Jennings et al.

(10) Patent No.: US 8,579,602 B1
(45) Date of Patent: Nov. 12, 2013

(54) ISOLATED DE-COUPLING OF FAN DRIVE IN EXHAUST ASSEMBLY

(75) Inventors: Rickey W. Jennings, Sparta, MO (US); Nicholas T. Bouray, Springfield, MO (US); Bradley F. Skidmore, Springfield, MO (US)

(73) Assignee: Loren Cook Company, Springfield, MO (US)

( * ) Notice: Subject to any disclaimer, the term of this patent is extended or adjusted under 35 U.S.C. 154(b) by 136 days.

(21) Appl. No.: 13/374,255

(22) Filed: Dec. 19, 2011

Related U.S. Application Data

(60) Provisional application No. 61/459,730, filed on Dec. 17, 2010.

(51) Int. Cl.
*F04D 29/60* (2006.01)

(52) U.S. Cl.
USPC ..... 417/360; 417/361; 417/423.6; 417/423.9; 417/423.15; 417/424.1; 454/341

(58) Field of Classification Search
USPC ..... 417/359, 360, 361, 423.6, 423.9, 417/423.14, 423.15, 424.1; 415/213.1, 415/214.1; 454/63, 253, 341
See application file for complete search history.

(56) References Cited

U.S. PATENT DOCUMENTS

| | | | | |
|---|---|---|---|---|
| 2,474,611 | A * | 6/1949 | Wylie | 417/239 |
| 2,847,156 | A | 8/1958 | Bleier | 417/353 |
| 2,898,030 | A * | 8/1959 | Hull | 417/360 |
| 2,932,441 | A * | 4/1960 | Harp | 417/360 |
| 3,090,545 | A * | 5/1963 | Bristol | 417/360 |
| 3,159,334 | A | 12/1964 | Hull | 417/423.14 |
| 3,159,335 | A * | 12/1964 | Gruner et al. | 417/423.14 |
| 3,170,621 | A * | 2/1965 | Morrison | 417/368 |
| 3,312,386 | A | 4/1967 | Hull et al. | 415/218.1 |
| 3,332,500 | A | 7/1967 | Bristol et al. | 416/196 R |
| 3,412,928 | A * | 11/1968 | Hull et al. | 415/214.1 |
| 5,439,349 | A | 8/1995 | Kupferberg | 415/212.1 |
| 7,018,287 | B2 | 3/2006 | Kupferberg et al. | 454/16 |
| 7,077,627 | B2 | 7/2006 | Kupferberg | 415/201 |
| 7,077,739 | B2 | 7/2006 | Kupferberg et al. | 454/1 |
| 7,320,636 | B2 | 1/2008 | Seliger et al. | 454/63 |
| 2005/0159101 | A1 | 7/2005 | Hrdina et al. | 454/356 |

OTHER PUBLICATIONS

Bull. No. 77-06-0205 of M.K. Plastics Corp. (Montreal): "Axijet-F High Plume Dilution Blower—DD 'EZ' Motor #4" accessed at www.mkplastics.com/documents/literature/Axijet_EZ_DD_77-06-0205.pdf (1 sheet).

(Continued)

*Primary Examiner* — Devon Kramer
*Assistant Examiner* — Nathan Zollinger
(74) *Attorney, Agent, or Firm* — Jonathan A. Bay

(57) ABSTRACT

An exhaust fan has an annular exhaust duct, a fan wheel, and a drive motor inside the core of the exhaust duct, and not inside the annular passage for the exhaust fluid. The exhaust duct has a tubular window frame extending between the inner and outer walls of the exhaust duct and creating service windows for a worker to reach in an de-couple the driver motor from both a bracket for its mount and also from the fan wheel. Temporary locking mechanisms actuated from reaching through the service windows removably hold the fan wheel to the exhaust duct while the drive motor is de-coupled and removed. The exhaust fan further includes self-centering mechanical connections between the drive motor and fan wheel so that the fan wheel does not have to be removed to be re-balanced.

13 Claims, 8 Drawing Sheets

(56) References Cited

OTHER PUBLICATIONS

Bull. No. HY05 of the PennBarry Co. (Plano, TX): "Hy-Blast Axcentrix" © 2005 (14 sheets).

Bull. No. BIF05 of the PennBarry Co. (Plano, TX): "Axial Bifucator Fans" © 2005 (18 sheets).

Bull. No. AX05 of the PennBarry Co. (Plano, TX): "Axcentrix Bifurcator Fans" © 2005 (25 sheets).

* cited by examiner

ISOLATED DE-COUPLING OF FAN DRIVE IN EXHAUST ASSEMBLY

CROSS-REFERENCE TO PROVISIONAL APPLICATION(S)

This application claims the benefit of U.S. Provisional Application No. 61/459,730, filed Dec. 17, 2010, the disclosure of which is incorporated herein by this reference thereto.

BACKGROUND AND SUMMARY OF THE INVENTION

The invention relates to rotary motors in fluid pump or fan systems and, more particularly, to the isolated de-coupling of the fan drive in an exhaust assembly. That way, the worker servicing the motor and/or drive system remains safely isolated from (and does not have to breach, access or open into the duct of) the exhaust fluid.

A number of additional features and objects will be apparent in connection with the following discussion of the drawings and preferred embodiment(s) and example(s).

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
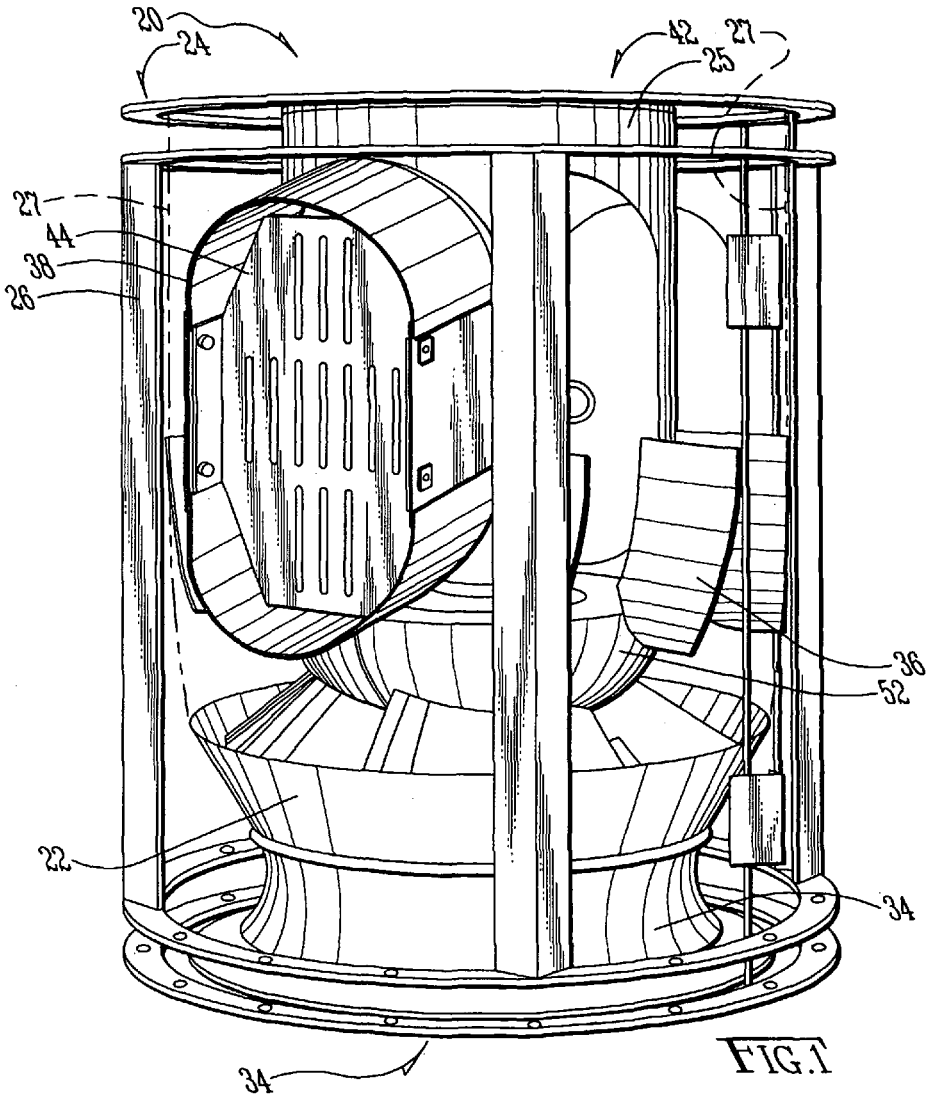
FIG. 1 is a perspective view of a roof exhaust fan provided with provisions in accordance with the invention for the isolated de-coupling of the fan drive.

FIG. 1 shows a roof exhaust fan 20 provided with provisions in accordance with the invention for the isolated de-coupling of the fan drive 30. This roof exhaust fan 20 has a fan wheel 22 (ie., impeller) suctioning exhaust fluid out of a ventilation system (not shown). The fan wheel 22 discharges the exhaust gases in an annular exhaust duct 24 defined by an inner housing 25, exterior support frames 26, and an outer housing 27.

Figure 3:
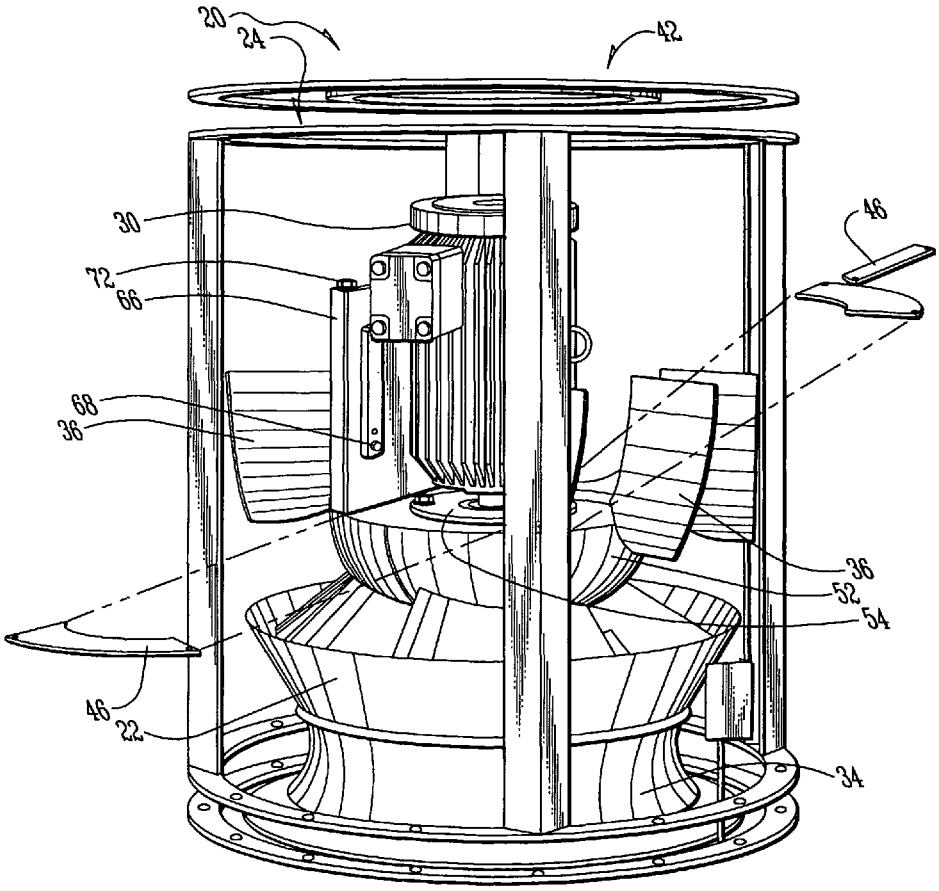
FIG. 3 is a perspective view semi-comparable to FIG. 2, except with portions broken away, and showing the removal of the weather seals that surround the drive motor's drive shaft.

As FIG. 3 shows better, this roof exhaust fan 20 is configured with a direct drive motor 30. The direct drive motor 30 is mounted at an elevation directly above the fan wheel 22. The direct drive motor 30 is oriented such that its drive shaft 32 aligns on a vertical axis, and extends straight down. The turning axis of the drive motor 30 is on the same axis of the fan wheel 22. Other fan drives are known in the art and are comparably adaptable to the advantages provided in accordance with the invention. This includes without limitation a fan drive which has pulleys, and hence the turning axis of the drive motor 30 is offset from the turning axis of the fan wheel 22 (this is not shown).

Given the foregoing brief introduction to a representative roof exhaust fan 20, it is an object of the invention to provide isolated de-coupling of the fan drive 30 from the fan wheel 22. In other words, it is an object of the invention to provide isolated de-coupling of the fan drive 30 from the fan wheel 22 all the while leaving the fan wheel 22 inside the intake duct 34 for the exhaust gases. That way, the worker servicing the motor 30 and/or drive system remains safely isolated from (and does not have to breach, access or open into the intake and/or exhaust duct 34 and/or 24 of) the exhaust fluid. It is another object of the invention that the worker can re-couple the fan drive 30 to the fan wheel 22 all again while remaining safely outside of the ducts 34 and 24 for the exhaust fluid.

A further object of the invention requires a brief introduction to fan wheels. At some original time (eg., in the factory), the fan wheel 22 was balanced relative to its fan drive 30 so that it would not spin out of balance (this is just the same as done for car tires).

In accordance with the prior art, when the fan wheel 22 is de-coupled from its fan drive 30, and then re-coupled, typically the balance is lost. And furthermore, typically the fan wheel 22 and fan drive 30 have to be re-balanced when the two are re-coupled.

However, it is a further object of the invention that the fan wheel 22 re-couples with its fan drive 30 and is self-centering on its balance axis. In other words, it is no longer necessary to re-balance the drive components because the fan wheel 22 re-gains its balance axis through inventive self-centering provisions.

These and other aspects and objects in accordance with the invention are provided by isolated de-coupling provisions as follows. Resuming in FIG. 1, the annular exhaust duct 24 has two kinds of interior features. One kind are a series of annularly distributed straightening vanes 36. The other kind are a pair of diametrically-opposed service windows 38.

These service windows 38 allow a worker to access the hollow core 42 of the annular exhaust duct 24 by reaching through these service windows 38.

Figure 2:
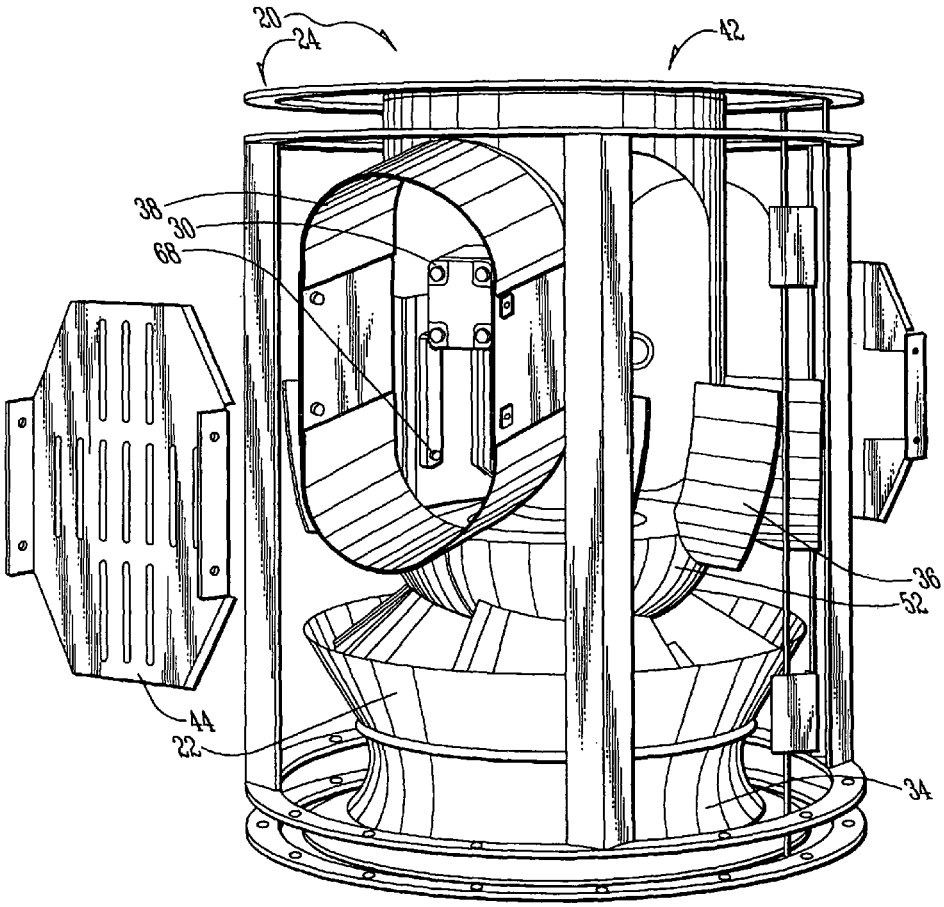
FIG. 2 is a perspective view comparable to FIG. 1 except showing the removal of the grills from the service-windows in the annular exhaust duct.

FIG. 1 shows that the service windows 38 are covered by grills 44 to keep out birds and/or some weather. It is an aspect of the invention that the service windows 38 ramp down in the outward direction, which also helps in draining away rainwater. FIG. 2 shows the cover grills 44 removed from the service windows 38.

FIG. 3 shows the removal of weather seals 46 that mount to the partition plate 48 between the hollow core 42 of the annular exhaust duct 24 and the fan wheel 22 (indeed, the hub 52 of the fan wheel 22). The fan wheel 22 occupies a position suspended just below this partition plate 48, as suspended from the fan drive 30. In this example, which has a direct drive motor 30, the fan wheel 22 is suspended off the drive shaft 32 of the drive motor 30 (perhaps with an intermediate mounting flange 54 therebetween). The weather seals 46 surround the drive motor 30's drive shaft 32 and attach to the partition plate 48. FIG. 3 shows the seals 46 removal.

Figure 4:
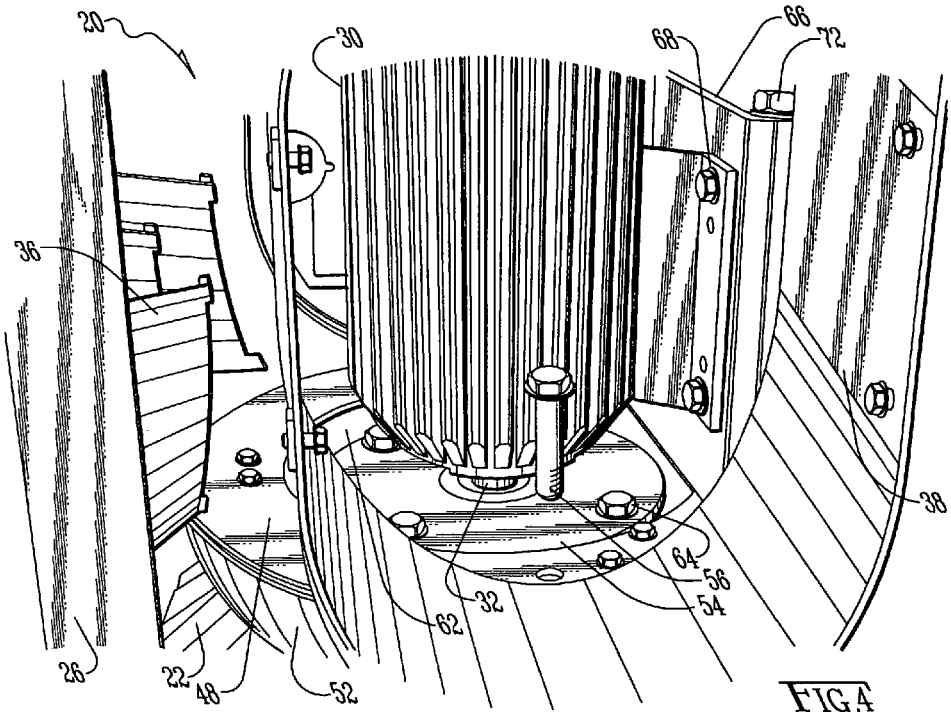
FIG. 4 is an enlarged-scale perspective view showing insertion of a representative one of the lock bolts (two are preferred) to lock secure the fan wheel inside the exhaust duct to a partition ring.

FIG. 4 is an enlarged-scale perspective view looking inside one of the service windows 38 at the drive motor 30, its drive shaft 32, and its mounting flange 54. FIG. 4 also shows the insertion of a representative one of two lock bolts 64 (the other is hidden from view). The lock bolts 64 thread into sockets provided for them in the fan wheel 22's hub 52's base plate 62. The worker has to turn the drive flange 54 about its spin axis until he or she locates the threaded sockets for the lock bolts 64. (This is readily doable by hand.) Then the worker drives the lock nuts home until the lock bolts 64 carry the weight of the suspended fan wheel 22.

Figure 5:
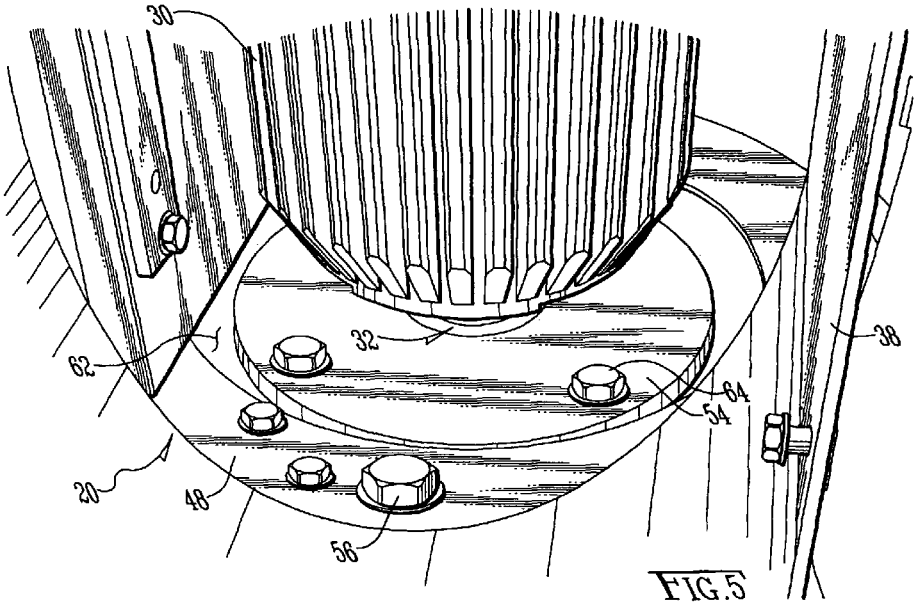
FIG. 5 is a perspective view from a viewing angle comparable to FIG. 4, except on an enlarged-scale and showing the lock bolt tightened, and further showing access to the hub bolts which secure the fan wheel to the fan drive.
Figure 6:
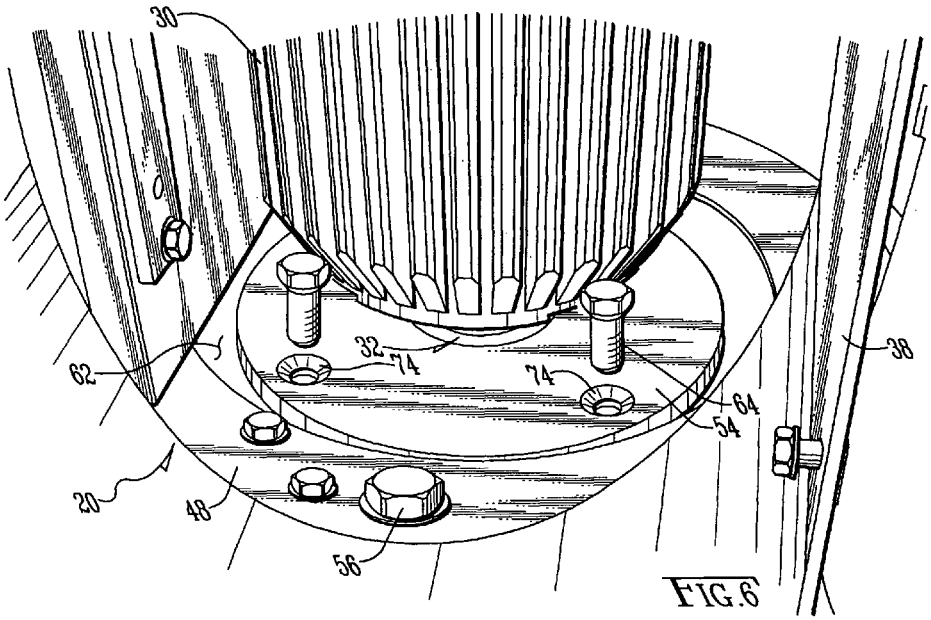
FIG. 6 is a perspective view comparable to FIG. 5, except show the hub bolts backed out.

FIG. 5 show the lock nuts have been twisted tight. FIG. 5 also shows that the drive flange 54 of the drive motor 30 is bolted to the fan wheel 22's hub 52's base plate 62 by four hub bolts 64 (only two in view, two others hidden from view). FIG. 6 is a view comparable to FIG. 5 except showing the hub bolts 64 backed out. At this stage, the fan wheel 22 and the fan drive 30 are de-coupled.

Figure 7:
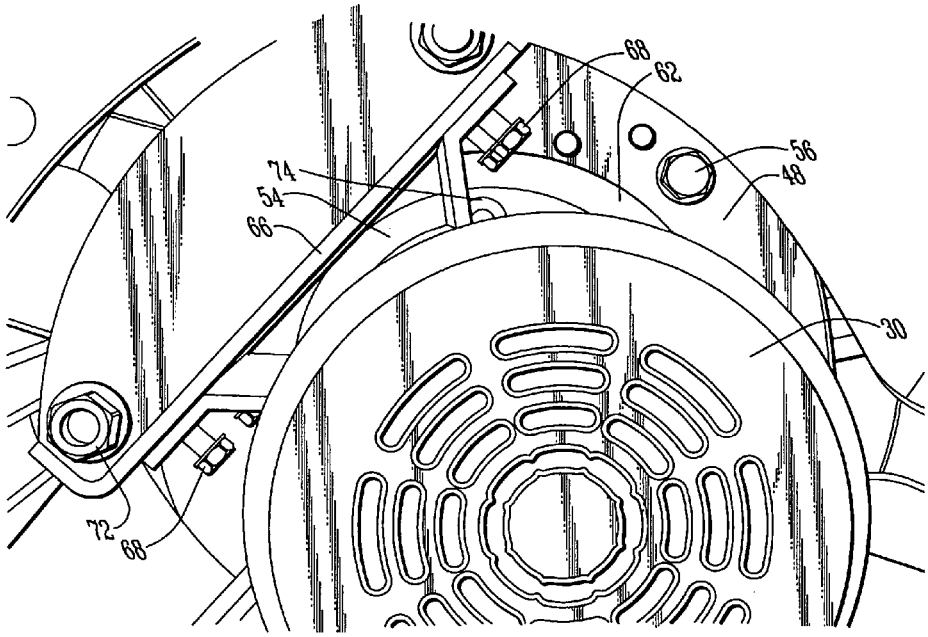
FIG. 7 is a top plan view of the drive motor for this roof exhaust fan along with showing the mounting bracket for the drive motor.

FIG. 7 is a top plan view of the cylindrical core 42 of the annular exhaust duct 24. This is where the drive motor 30 is mounted and this is the cavity 42 which the service windows 38 provide reach-through access. The motor 30 is mounted to a bracket 66 for it by four mounting bolts 68, which are shown partially backed out. As a convenience, the mounting bracket 66 has two nuts 72 welded to it that are the same thread size as the lock bolts 64. During non-use, these nuts 72 provide a convenient place to dock and store the lock bolts 64 until needed for a successive use.

Figure 8:
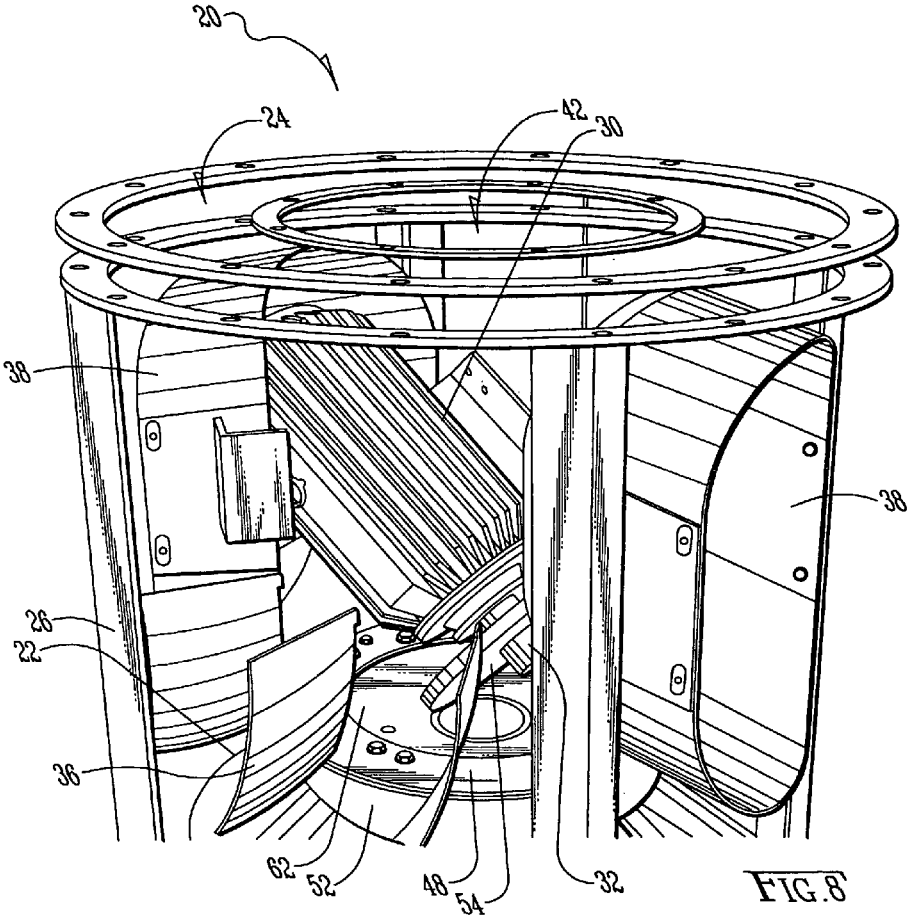
FIG. 8 is perspective view comparable to FIG. 2 except from an angle a quarter of turn counter-clockwise, and showing the tipping of the drive motor out through the service window in the annular exhaust duct.

By the stage of FIG. 8, the drive motor 30 has been un-bolted from the fan wheel 22 and un-bolted from its mounting bracket 66. Hence the drive motor 30 is free. FIG. 8 shows the drive motor 30 being tipped out and withdrawn through one of the service-windows 38.

Re-installation of a drive motor 30 (presumptively a replacement drive motor) is achieved by pretty much stepping through the above steps in reverse.

Returning to FIG. 6, it shows that the drive flange 54 has counter-sunk bolt holes 74 for the hub bolts 64 to pass through. Indeed, the hub bolts 64 have conic shoulders under their bolt heads.

Hence re-bolting the drive flange 54 to the fan wheel 22's hub 52's base plate 62 achieves self-centering of the fan wheel 22's spin axis to the drive motor 30's spin access. The balance of the fan wheel 22 is hence not lost, but re-gained in this fashion.

It is an advantage of the invention that the fan wheel 22 re-attaches without having to re-balance the drive system after every time the fan drive 30 is de-coupled.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. An exhaust fan (20) for exhausting an exhaust fluid, comprising:

an intake duct (34) for the exhaust fluid;

an annular exhaust duct (24) having an annular exhaust passage for the exhaust fluid between an inner housing (25) and an outer housing (27), the inner housing (25) extending between an apertured partition plate (48) and a spaced away other end, the inner housing (25) defining a core (42), the apertured partition plate (48) having an enlarged central aperture;

a fan wheel (22) disposed between the intake and exhaust ducts (34,24), the fan wheel (22) having a base plate (62) closely adjacent to the partition plate (48) on the opposite side from the core (42);

a motor mounting bracket (66) mounted inside the inner housing (25);

a drive motor (30) disposed in the core (42) of the inner housing (25) and removably mounted to the mounting bracket (66) therefor, said drive motor (30) turning a drive hub (54) that occupies the central aperture of the partition plate (48);

mechanical connections (64) for removably mounting the drive hub (54) to the base plate (62) of the fan wheel (22);

at least one window frame (38) defining a service window and extending between the inner and outer housings (25,27) which thereby allows a worker access into the core (42) and thus to the drive motor (30), the drive motor mounting bracket (66), the hub-fastening connections (64) and the partition plate (48) without opening or accessing into either of the ducts (34,24) for the exhaust fluid, whereby the worker is isolated from the ducts and the exhaust fluid when removing the drive motor;

temporary locking connections (56) actuated from inside the core (42) of the inner housing (25) by a worker reaching through the window frame (38) of the service window, said temporary locking connections temporarily locking the base plate (62) of the fan wheel (22) to partition plate (48) of the exhaust duct (24) whereby the drive motor (30) can be de-coupled from the base plate (62) of the fan wheel (22) and the drive motor mounting bracket (66) and removed while the partition plate (48) carries the weight of the fan wheel (22).

2. The exhaust fan (20) of claim 1, further comprising:

locking bolts (56) serving as the temporary locking connections; and wherein the base plate (62) has internally-threaded holes for the locking bolts (56) to tighten into and the partition plate (48) has through-holes which align therewith, whereby tightening the locking bolts (56) temporarily carries the weight of the fan wheel (22) to the partition plate (48).

3. The exhaust fan (20) of claim 1, further comprising self-centering mechanical connections (64,74) for removably mounting the drive hub (54) to the base plate (62) of the fan wheel (22).

4. The exhaust fan (20) of claim 3, further comprising:

hub bolts (64) having conic shoulders serving in part as the self-centering mechanical connections (64,74);

wherein the base plate (62) has internally-threaded holes for the hub bolts (64) to tighten into and the drive hub (54) has counter-sunk bolt holes (74) which align therewith, whereby tightening the hub bolts (64) self-centers the fan wheel (22) to the drive hub (54).

5. The exhaust fan (20) of claim 1, wherein:

the frame (38) of the service window is tubular and ramps down in the outward direction from the inner housing (25) to the outer housing (27) which thereby helps in draining away rainwater from the core (42).

6. The exhaust fan (20) of claim 1, further comprising:

another window frame diametrically-opposed from said at least one window frame (38) which thereby allows a worker to use both arms from both sides of the exhaust duct (24) when manually handling the drive motor (30) inside the core (42) of the inner housing (25).

7. The exhaust fan (20) of claim 6, further comprising:

covers (44) to cover the frames (38) of the service windows to thereby keep out birds or weather.

8. The exhaust fan (20) of claim 1, further comprising:

weather seals (46) that removably attach to the partition plate (48) and seal the drive hub (54).

9. An exhaust fan (20) for exhausting an exhaust fluid, comprising:

an intake duct (34);

an inner housing (25) and a spaced outer housing (27) defining an annular exhaust duct (24), the inner housing (25) extending between an apertured partition (48) and a spaced away other end, the inner housing (25) defining a core (42), the apertured partition (48) having an enlarged central aperture;

a fan wheel (22) disposed to motivate the exhaust fluid between the intake and exhaust ducts (34,24), the fan wheel (22) having a partition-coupling provision adjacent to the partition (48) on the opposite side from the core (42);

a motor mounting bracket (66) having mounting provisions inside the inner housing (25);

a drive motor (30) disposed in the core (42) and removably mounted to the mounting provisions of the mounting bracket (66), said drive motor (30) having a drive shaft (32) that turns the fan wheel (22) through the central aperture of the partition (48);

couplings for transferring drive power from the drive shaft (32) to the fan wheel (22);

at least one window frame (38) defining a service window and extending between the inner and outer housings (25,27) which thereby allows a worker access into the core (42) and thus to the drive motor (30), the mounting provisions of the drive motor mounting bracket (66), the couplings, and the partition (48) without opening or accessing into either of the ducts (34,24), whereby the worker is isolated from the ducts and the exhaust fluid when removing the drive motor;

temporary locking connections actuated from inside the core (42) of the inner housing (25) by a worker reaching through the window frame (38) of the service window, said temporary locking connections temporarily locking the partition-coupling provision of the fan wheel (22) to partition (48) of the exhaust duct (24) whereby the drive motor (30) can be de-coupled from the partition-coupling provision of the fan wheel (22) and the mounting provisions of the drive motor mounting bracket (66) and removed while the partition (48) carries the weight of the fan wheel (22).

10. The exhaust fan (20) of claim 9, further comprising self-centering mechanical connections for removably remounting the connection between the drive shaft (32) and the fan wheel (22).

11. The exhaust fan (20) of claim 9, wherein:

the frame (38) of the service window is tubular and ramps down in the outward direction from the inner housing (25) to the outer housing (27) which thereby helps in draining away rainwater from the core (42).

12. The exhaust fan (20) of claim 9, further comprising:

another window frame diametrically-opposed from said at least one window frame (38) which thereby allows a worker to use both arms from both sides of the exhaust duct (24) when manually handling the drive motor (30) inside the core (42) of the inner housing (25).

13. The exhaust fan (20) of claim 12, further comprising:

covers (44) to cover the frames (38) of the service windows to thereby keep out birds or weather.

* * * * *